US008851036B1

(12) United States Patent
Haefner

(10) Patent No.: US 8,851,036 B1
(45) Date of Patent: Oct. 7, 2014

(54) INTERNAL COMBUSTION ENGINE AND METHOD FOR PRODUCING SUCH AN ENGINE

(71) Applicant: Daimler AG, Stuttgart (DE)

(72) Inventor: Jochen Haefner, Lorch (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 13/844,996

(22) Filed: Mar. 17, 2013

Related U.S. Application Data

(63) Continuation-in-part of application No. PCT/EP2010/006291, filed on Oct. 14, 2010.

(51) Int. Cl.

| | |
|---|---|
| ***F01M 9/10*** | (2006.01) |
| ***F01M 11/02*** | (2006.01) |
| *F01L 1/053* | (2006.01) |
| *F01L 1/047* | (2006.01) |

(52) U.S. Cl.
CPC ..... *F01M 11/02* (2013.01); *F01M 9/10* (2013.01); *F01L 1/053* (2013.01); *F01L 1/047* (2013.01); *F01M 9/101* (2013.01); *F01M 9/102* (2013.01)
USPC ..... 123/90.34

(58) Field of Classification Search
CPC ..... F01M 9/102; F01M 9/101; F01M 9/10; F01L 1/053; F01L 1/047
USPC ..... 123/90.34
See application file for complete search history.

(56) References Cited

U.S. PATENT DOCUMENTS

| | | | | |
|---|---|---|---|---|
| 3,847,499 | A * | 11/1974 | Heyworth et al. | 408/1 R |
| 4,777,842 | A * | 10/1988 | Yamada | 74/567 |
| 5,018,497 | A | 5/1991 | Tsuchida | |
| 5,167,208 | A * | 12/1992 | Rasiah | 123/197.4 |
| 6,062,187 | A * | 5/2000 | Pattakos et al. | 123/197.1 |
| 2004/0040521 | A1 * | 3/2004 | Hardin | 123/41.82 R |
| 2006/0048742 | A1 * | 3/2006 | Sagara et al. | 123/198 E |

FOREIGN PATENT DOCUMENTS

| | | |
|---|---|---|
| DE | 37 24 494 | 2/1989 |
| DE | 39 12 495 | 10/1990 |

* cited by examiner

*Primary Examiner* — Lindsay Low
*Assistant Examiner* — Charles Brauch
(74) *Attorney, Agent, or Firm* — Klaus J. Bach

(57) ABSTRACT

In an internal combustion engine comprising a plurality of cylinders with at least one cylinder head including inlet channels extending from an inlet flange surface to a cylinder inlet and outlet channels extending from a cylinder outlet to an opening in an outlet flange surface and an oil chamber provided in the cylinder head for supplying lubricant to an actuation device for gas exchange valves, the inlet flange and the outlet flange have flat surfaces which are arranged at an angle relatively to each other so that the surface planes intersect above the cylinder head and the cylinder head, as a result, has an essentially triangular cross-section.

8 Claims, 2 Drawing Sheets

INTERNAL COMBUSTION ENGINE AND METHOD FOR PRODUCING SUCH AN ENGINE

This is a Continuation-In-Part application of pending international patent application PCT/EP2010/006291 filed Oct. 14, 2010 and claiming as the priority date of German patent application.

BACKGROUND OF THE INVENTION

The invention relates to an internal combustion engine with an oil chamber formed in the cylinder head for the lubrication of cylinder head components and to a method for producing such an engine.

Internal combustion engines with a plurality of cylinders and at least one cylinder head are well and produced in large numbers. They include cylinder heads with inlet channels which open to an inlet flange surface and outlet channels which open to an oppositely arranged outlet flange surface. Furthermore, an oil chamber may be provided for lubricating the actuation device for gas exchange valves and also a coolant chamber for cooling the cylinder head.

The conventional combustion engines have a relatively high level of complexity, especially in terms of the manufacturing thereof, which is due in particular to a plurality of flange surfaces that require sealing. This results in undesirably high costs for the internal combustion engine.

It is therefore the object of the present invention to provide an internal combustion engine of the aforesaid type and a method for producing such an engine at lower costs.

SUMMARY OF THE INVENTION

In an internal combustion engine comprising a plurality of cylinders with at least one cylinder head including inlet channels extending from an inlet flange surface to a cylinder inlet and outlet channels extending from a cylinder outlet to an opening in an outlet flange surface and an oil chamber provided in the cylinder head for supplying lubricant to an actuation device for gas exchange valves, the inlet flange and the outlet flange have flat surfaces which are arranged at an angle relatively to each other so that the surface planes intersect above the cylinder head and the cylinder head, as a result, has an essentially triangular cross-section.

In comparison to standard combustion engines, it is thus possible to dispense with a flange surface requiring sealing between the cylinder head and a cylinder head cover as well as with the cylinder head cover itself. The combustion engine according to the invention thus has a low level of complexity, which keeps the production effort and thus the costs thereof low. It furthermore has only a small number of parts, which also contributes to the low costs. Because the flange surfaces for sealing the cylinder head and the cylinder head cover are integrated into the inlet flange surface and into the outlet flange surface, the effort for sealing the internal combustion engine as well as the effort for installing head cover can be considered as minor, which further contributes to keeping the total costs within narrow limits. Furthermore, the internal combustion engine of the invention is particularly process reliable and can therefore be produced economically.

Another advantage of the combustion engine of the invention is that it requires very little installation space due in particular to the arrangement of the flange surfaces at an incline to one another. It is thus possible to solve or avoid package problems, especially in an area where space is critical such as an engine compartment of a motor vehicle, in particular a passenger car.

In an advantageous embodiment of the invention, the oil chamber of the cylinder head has at least one opening to each of the two flange surfaces. The oil chamber is thus particularly easy to access, which keeps the installation and maintenance effort of the combustion engine at a low level. Furthermore, this makes the cylinder head and thus the entire combustion engine particularly simple and economical to produce.

If provision is made of a longitudinal support above the oil chamber with passages for spark plugs and/or fuel injection nozzles or the like, it is advantageous that the spark plugs and/or the fuel injector nozzles are particularly easily mounted to the cylinder head or arranged thereon.

A particularly time- and cost-efficient installation of the combustion engine is possible if cylinder head bolts for bolting the cylinder head onto an engine housing are directly accessible via the openings of the oil chamber in the flange surfaces. The cylinder head, for example, can thus be bolted onto the engine housing with a basic standard tool and in an ergonomically accessible manner for a person performing the installation. Cycle times for the production and installation of the combustion engine can thus be shortened, which keeps the costs low.

In another advantageous embodiment of the invention, the inlet flange surface of the cylinder head is, at least in some areas, covered by an intake module that ensures a seal, in particular a fluid-tight seal of the inlet channels as well as the opening to the oil chamber. In other words this means that, compared to standard combustion engines, the sealing function of the cylinder head cover is at least partially integrated in the intake module, which also covers the inlet channels. The intake module thus has a high level of functional integration, which keeps the number of parts and the cost of the combustion engine low.

The intake module is made, for example, of plastic such that the latter and thus the combustion engine are especially lightweight. Furthermore, this results in particularly low material costs, which contributes to the low costs for the combustion engine.

Furthermore, it is highly advantageous if the outlet flange surface of the cylinder head is covered by an exhaust manifold module, which ensures a seal, in particular a fluid-tight seal, and also an oil-tight seal of the outlet channels as well as the openings to the oil chamber. Compared to standard combustion engines, the sealing function of the cylinder head cover is thus integrated, at least partially, in the exhaust manifold module so that the exhaust manifold module has a high level of functional integration. This leads to a small number of parts, to low costs, and also to a low weight of the internal combus-tion engine.

The exhaust manifold module is a thin-walled formed part made of a sheet metal such that the effort and costs for the production of the exhaust manifold module are low, but also such that the latter is able to withstand high stresses, in particular high temperature stresses, during the operation of the combustion engine without sustaining damage over a long service life.

The actuation device for the gas exchange valves comprises, for example, a cam shaft associated with the outlet channels and/or a cam shaft associated with the inlet channels. For mounting the cam shafts on the cylinder head, the cylinder head includes a bearing race that is partially formed by the cylinder head. For holding the cam shafts on the cylinder head, the bearing race is also partially formed by bearing caps, which are fastened, for example bolted, onto the cylinder head. Advantageously, it is possible for the bearing caps to be integrated in the intake manifold module and/or the exhaust manifold module. If one of these modules with the integrated bearing caps is fastened, for example bolted, onto the cylinder head, a connection of the bearing caps to the cylinder head for forming the corresponding bearing race is also achieved in a quasi-parallel manner. The cam shaft or cam shafts can thus be held on the cylinder head in a particularly expedient manner and with only a few parts. This also contributes to lowering the costs and to the light weight of the combustion engine of the invention. Additional bearing caps and the corresponding installation steps for fastening these bearing caps onto the cylinder head are not necessary.

In an advantageous embodiment of the invention, the mounting plane of the bearing caps for the cam shafts lies in the flange surfaces of the intake manifold module and/or the exhaust manifold module. It is thus possible to dispense with a separate production process for cutting and grinding the mounting plane thereby avoiding unwanted costs increases or such an additional production process; hence the combustion engine can be produced in a particularly time- and cost-efficient manner.

The second aspect of the invention relates to a method for producing a combustion engine, wherein, during the casting or molding of the cylinder head, the oil chamber is molded by cores that are inserted laterally through the openings in the flange areas. In other words the oil chamber can be modelled by lateral sliders of a casting device and an oil chamber core can be dispensed with. The method of the invention thus allows the combustion engine to be manufactured in a particularly economical manner.

The sliders can be in the form of steel dies which further reduces the costs for manufacturing the combustion engine. Sand core shooting is therefore not necessary. The dies and the support are also less sensitive to tolerances than is the case with a sand core support. This enables the forming of very thin wall thicknesses, which entails a lighter weight and lower material costs in the production of the internal combustion engine. This furthermore leads to a particularly high process reliability of the method, which means an additional cost reduction.

Advantages, features, and details of the invention will become more readily apparent from the following description of a preferred exemplary embodiment with reference to the accompanying drawings. The features and combinations of features mentioned in the description and as shown in the figures are not only usable in the indicated combination, but also in other combinations without exceeding the scope of the invention.

DESCRIPTION OF AN EXEMPLARY EMBODIMENT

Figure 1:
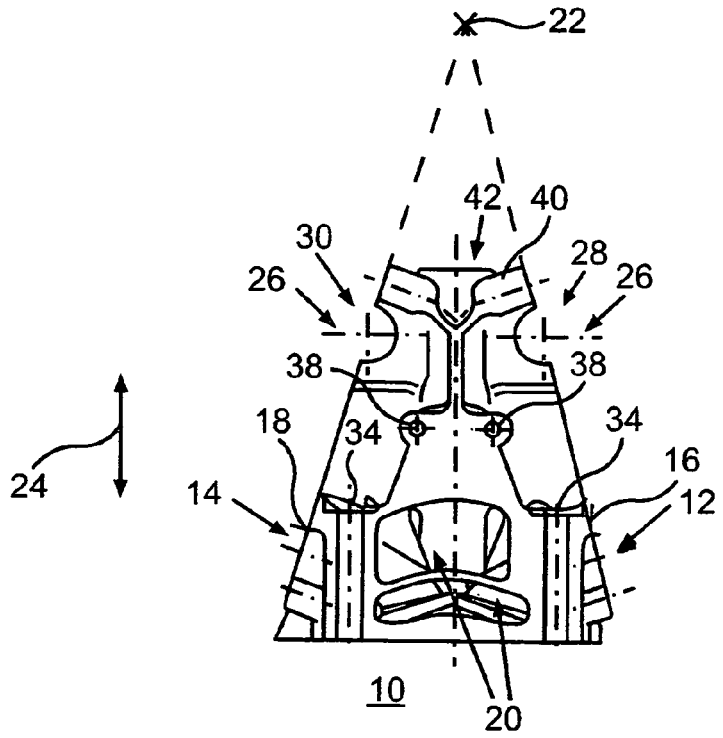
FIG. 1 is a schematic cross-sectional view of a cylinder head of a combustion engine, wherein the cylinder head has an at least essentially triangular cross-section.
Figure 2:
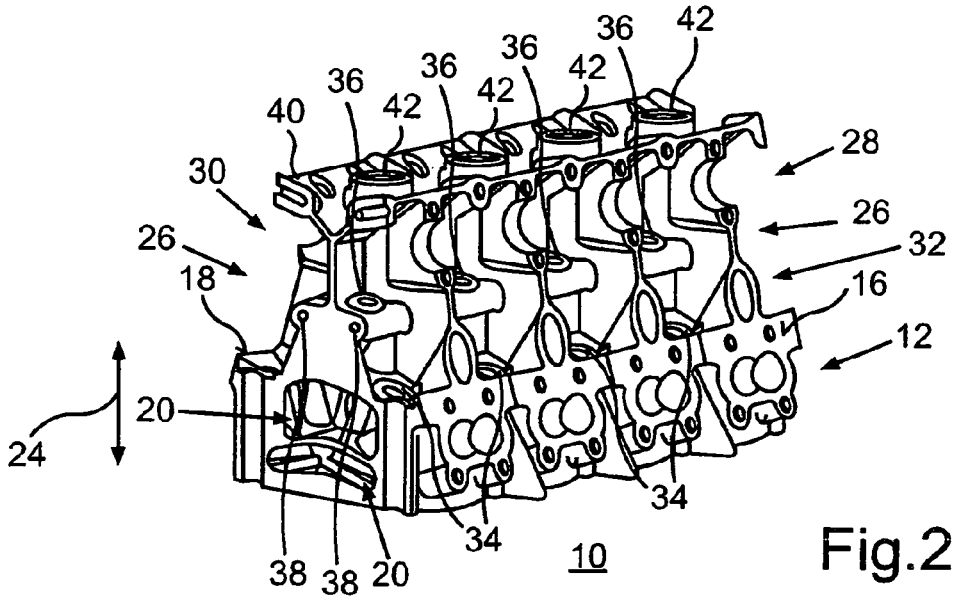
FIG. 2 is a schematic perspective view of the cylinder head according to FIG. 1.
Figure 3:
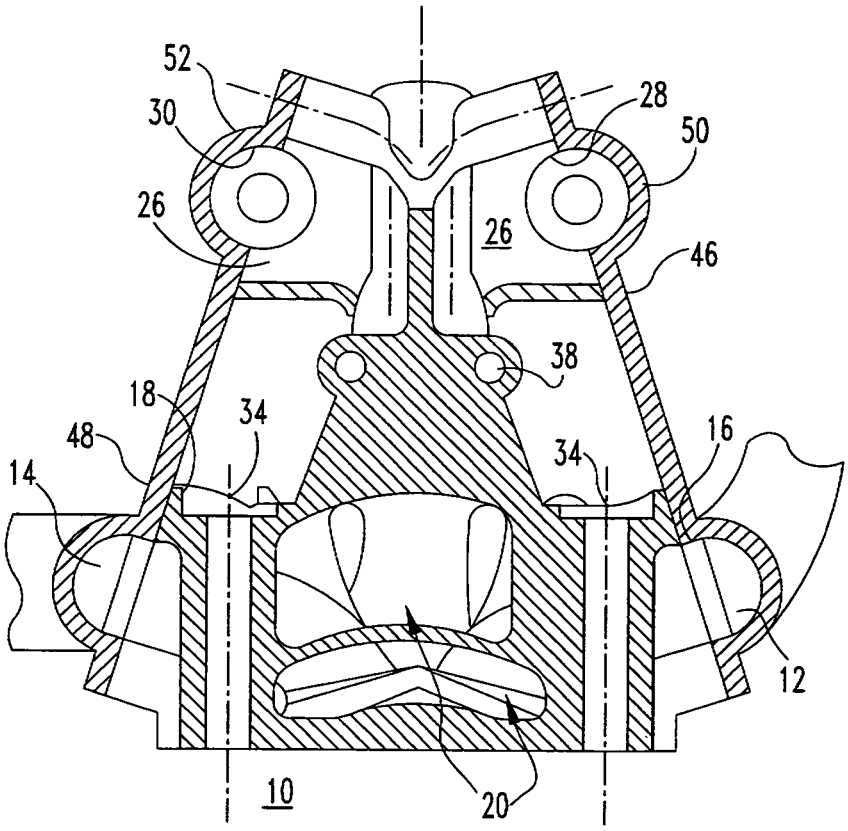
FIG. 3 is a schematic cross-sectional view, like FIG. 1 with the intake and exhaust Side manifold modules mounted on the cylinder head.

FIGS. 1 and 2 show a cylinder head 10 for a combustion engine with a plurality of cylinders. The cylinder head 10 has inlet channels 12 via which air or a fuel-air mix can flow into the cylinders of the combustion engine. The cylinder head 10 furthermore has outlet channels 14 via which exhaust resulting from the combustion of the air mixed with fuel in the cylinders or the air-exhaust mix is able to flow out of the cylinders. As can be discerned in FIG. 1 in particular, the inlet channels 12 open at a planar inlet flange-side cylinder head surface 16 and the outlet channels 14 open at a planar outlet flange-side cylinder head surface 18 arranged opposite the Inlet flange surface 16. The cylinder head 10 further includes a chamber which accommodates the inlet channels 12 and the outlet channels 14 as well as a coolant chamber 20. The coolant chamber 20 is also designated as a water chamber in which coolant is present, especially during the operation of the internal combustion engine, for cooling the engine and in particular the cylinder head.

Particularly in FIG. 1 it is clearly shown that the planar inlet flange-side cylinder head surfaces 16 and the planar outlet flange-side cylinder head surfaces 18 are arranged at an incline to one another such that a line 22 of intersection of the two planar flange-side cylinder surfaces 16 and 18 lie in the vertical direction indicated by a directional arrow 24 above the cylinder head 10, and the cylinder head 10 has an at least essentially triangular cross-section.

The cylinder head 10 also has an oil chamber 26 on both sides, which is arranged in the vertical direction of the internal combustion engine and the cylinder head 10 as indicated by the directional arrow 24 above the coolant chamber 20 and which has a particularly wide opening at each of the two planar flange-side cylinder head surfaces 16 and 18. The oil chamber 26 is designed to hold oil for lubricating and cooling an actuator mechanism for the actuation of gas exchange valves. The actuator mechanism comprises a cam shaft associated with the valves for the inlet channels 12 by means of which the Inlet valves of the gas exchange valves are actuated. The actuator mechanism further comprises a cam shaft associated with the valves for the outlet channels 14 by means of which the outlet valves of the gas exchange valves can be actuated.

In the oil chambers 26, provision is made for bearing races 28 or 30 corresponding to each of the cam shafts, which races are partially formed by the cylinder head 10 and via which the respective cam shafts are supported on the cylinder head 10.

In order to cover the camshaft bearings and also seal the oil chamber 26 and also the inlet flange-side cylinder head surface 16, an intake side manifold module 46 can be bolted onto the cylinder head 10. In other words, the intake manifold module 46 assumes the function of covering and sealing the oil chamber 26 and the camshaft bearings as well as the function of capping and sealing the inlet channels 12. In order to cap and seal the oil chamber 26 completely and cover and seal the outlet channels 14, an exhaust side manifold module 48 is mounted in the same way at the opposite side of the cylinder head 10.

In this way the oil chamber 26 as well as the inlet channels 12 and the outlet channels 14 are covered and sealed and also the camshaft bearings are covered by means of the planar intake manifold module and the planar exhaust manifold module. The arrangement provides for a high level of functional integration such that the number of parts and thus the cost of the combustion engine can be kept down. Hence no provisions for additional sealing surfaces are needed and the combustion engine and in particular the cylinder head 10 can therefore be produced in an especially time- and cost-efficient manner. Furthermore, the cylinder head 10, and thus the entire combustion engine requires very little space, in particular because of the at least essentially triangular configuration of the cross-section.

For mounting the cam shafts to the cylinder head 10, bearing caps 50, 52 are connected to the cylinder head 10, preferably integrated into the intake side manifold module 46 and, respectively, the exhaust side manifold module 48 so as to form the bearing races 28 and 30. In order to keep the weight and number of parts of the combustion engine particularly low, the bearing caps of the bearing race 28 may advantageously be integrated into the intake manifold module, that is, formed integrally with the intake manifold module, and the bearing caps of the bearing race 30 may be integrated into the exhaust manifold module so as to form a single piece with the exhaust manifold module.

The cylinder head 10 further comprises receiving openings 32 in which injectors are disposed. Fuel can be injected directly into the cylinders by means of the injectors. The cylinder head 10 further comprises receiving openings 34 in which the gas exchange valves are held. Further provision is made of receiving openings 36 for corresponding hydraulic valve actuators by means of which it is possible to compensate for the play in the gas exchange valve operating mechanism. Also shown in FIGS. 1 and 2 are boreholes 38 for longitudinal oil channels via which the cam shafts and in particular bearing surfaces on which the cam shafts are mounted in the bearing races 28 or 30 can be supplied with oil and thus be lubricated and cooled.

For attaching spark plugs by which a mixture of air and of fuel injected into the cylinders by the injectors can be ignited, above the oil chamber 26 in the vertical direction as indicated by the directional arrow 24 a central longitudinal support 40 is provided, which has passages 42 extending though the cylinder head for accommodating and installing corresponding spark plugs.

LISTING OF REFERENCE NUMERALS

10 Cylinder head
12 Inlet channels
14 Outlet channels
16 Inlet flange surface
18 Outlet flange surface
20 Coolant chamber
22 Intersecting line
24 Directional arrow
26 Oil chamber
28 Bearing race
30 Bearing race
32 Receiving opening
34 Receiving opening
36 Receiving opening
38 Borehole
40 Longitudinal support
42 Passage
46 Intake side manifold module
48 Exhaust side manifold module
50 Bearing cap
52 Bearing cap

What is claimed is:

1. An internal combustion engine with a plurality of cylinders with at least one cylinder head (10) having a planar inlet flange-side cylinder head surface (16) at one side of the cylinder head and a planar outlet flange-side cylinder head surface (18) at an opposite side of the cylinder head, and the cylinder head including air inlet channels and gas outlet channels (12, 14) with openings to the respective inlet and outlet flange-side cylinder head surfaces (16, 18), and also camshaft bearing structures (28) and an oil supply chamber (26) for receiving lubricating oil for lubricating the camshaft bearing structures (28) and actuating devices for gas exchange valves, the inlet flange-side cylinder head surface (16) and the outlet flange-side cylinder head surface (18) being arranged at an angle with respect to one another such that an imaginary line (22) of intersection of the planes defined by the two flange-side cylinder head surfaces (16, 18) lies above the cylinder head (10) and the cylinder head (10) has an at least essentially triangular cross-section with manifold modules (48, 48) mounted onto the planar flange-side cylinder head surfaces (16, 18) which seal the as inlet and outlet channels (12, 14) as well as the oil supply chamber (26).

2. The combustion engine according to claim 1, wherein the oil supply chamber (26) of the cylinder head (10) has at least one opening at each of the two flange-side cylinder head surfaces (16, 18).

3. The combustion engine according to claim 1, wherein above the oil supply chamber (26), there is a longitudinal support structure (40) having passages (42) for the installation of spark plugs.

4. The combustion engine (10) according to claim 1, wherein the oil supply chamber (26) is established by openings in the flange-side cylinder head surfaces (16, 18) which are formed and arranged so as to permit direct access to cylinder head bolts for bolting the cylinder head onto an engine housing.

5. The combustion engine according to claim 1, wherein camshaft bearings are disposed on opposite sides of the cylinder head by bearing caps mounted on flange-side cylinder head surfaces (16, 18) of the intake module and, respectively, the exhaust manifold module.

6. The combustion engine according to claim 5, wherein the outlet flange-side cylinder head surface (18) of the cylinder head (10) is covered by an exhaust side manifold module (48) which seals the outlet channels (14) as well as the openings to the oil chambers (26).

7. The combustion engine according to claim 5, wherein bearing caps (52) for mounting the inlet valve cam shafts to the cylinder head are integrated into the intake side manifold module (46).

8. The combustion engine according to claim 6, wherein bearing caps (50) for mounting the outlet valve camshaft to the cylinder head are Integrated into the exhaust flange-side manifold module (48).

* * * * *